US008146677B2

(12) United States Patent
Kim

(10) Patent No.: US 8,146,677 B2
(45) Date of Patent: Apr. 3, 2012

(54) HYDRAULIC BREAKER ASSEMBLY

(76) Inventor: Jae-Mog Kim, Incheon (KR)

( * ) Notice: Subject to any disclaimer, the term of this patent is extended or adjusted under 35 U.S.C. 154(b) by 163 days.

(21) Appl. No.: 12/451,425

(22) PCT Filed: Jun. 25, 2008

(86) PCT No.: PCT/KR2008/003648

§ 371 (c)(1),
(2), (4) Date: Nov. 10, 2009

(87) PCT Pub. No.: WO2009/157599

PCT Pub. Date: Dec. 30, 2009

(65) Prior Publication Data

US 2010/0139939 A1 Jun. 10, 2010

(51) Int. Cl.
*B25D 17/24* (2006.01)

(52) U.S. Cl. ..... 173/115; 173/89; 173/201; 173/210

(58) Field of Classification Search ..... 173/4, 13, 173/53, 115, 89, 185, 201, 210, 211
See application file for complete search history.

(56) References Cited

U.S. PATENT DOCUMENTS

| | | | | |
|---|---|---|---|---|
| 4,724,912 | A * | 2/1988 | Miyazaki et al. | 173/162.1 |
| 5,285,858 | A * | 2/1994 | Okada et al. | 173/211 |
| 5,370,193 | A * | 12/1994 | Sippus et al. | 173/211 |
| 6,648,079 | B2 * | 11/2003 | Deimel et al. | 173/91 |
| 2001/0043007 | A1 * | 11/2001 | Jang | 299/69 |
| 2006/0037845 | A1 * | 2/2006 | Yoshimura et al. | 200/50.01 |
| 2008/0173457 | A1 * | 7/2008 | Kahra | 173/90 |

FOREIGN PATENT DOCUMENTS

| | | |
|---|---|---|
| JP | 11-254351 | 9/1999 |
| JP | 2005-299091 | 10/2005 |
| KR | 1994-4307 | 6/1994 |
| KR | 363721 | 10/2004 |
| KR | 381252 | 4/2005 |
| KR | 2008-86277 | 9/2008 |

* cited by examiner

*Primary Examiner* — Thanh K Truong
*Assistant Examiner* — Nathaniel Chukwurah
(74) *Attorney, Agent, or Firm* — Daniel P. Burke & Associates, PLLC

(57) ABSTRACT

A hydraulic breaker assembly including a head cap, a cylinder, and a front head, which are mounted in a casing, wherein corresponding faces of the front head and the cylinder are connected by connecting pins, wherein the cylinder and the head cap located above the cylinder are fixed together by fastening bolts, and wherein the front head, the cylinder, and the head cap are supported on an inner side of the casing by variable dampers, which are brought into close contact with the front head, the cylinder, and the head cap. The movement in the casing is thus prevented so that the head cap, the cylinder, and the front head are strongly coupled together. The length of the fastening bolt is reduced to minimize the impact-generating section so that the bolt is protected from distortion stress occurring upon striking of the rod, thereby increasing durability.

24 Claims, 10 Drawing Sheets

HYDRAULIC BREAKER ASSEMBLY

TECHNICAL FIELD

The present invention relates, in general, to a hydraulic breaker assembly which improves an assembly structure including a head cap, a cylinder, and a front head, which are assembled in a casing, thereby increasing the durability thereof.

BACKGROUND ART

As is generally known in the art, a hydraulic breaker includes a head cap having hydraulic passages for supplying and receiving hydraulic pressure, a cylinder having a cylinder chamber, in which a piston is reciprocated, and elements, e.g. valves or the like, for operating the piston, and a front head having a striking rod, which is connected to the piston so as to implement a striking stroke through reciprocating operation. The above constitutional elements are separately formed and are combined into a single unit by four long bolts. In operation, the piston strikes the rod while moving up and down by means of hydraulic pressure supplied to the cylinder, so that the rod can break a rock or the like.

As shown in FIG. 1, a conventional hydraulic breaker 10 in the related art includes a cylinder 50 having a piston therein, a front head 40 installed on a lower end of the cylinder 50 and having a rod 70 therein as striking means, and a head cap 30 connected to an upper end of the cylinder 50, wherein the head cap 30, the cylinder 50, and the front head 40 each have through-holes, into which long bolts 80 are inserted so as to connect them.

Herein, nuts fastening the long bolts 80 are coupled to the bolts in mounting holes 40-2 provided in the front head 40, and the side faces of the front head, the cylinder, and the head cap are supported by variable dampers 30-1, 30-2, 40-1, and 50-1 inserted into the inside of the casing 60.

In the breaker 10, when a hydraulic or pneumatic pressure source is supplied to the inside of the cylinder 50, the piston moves down to strike the rod 70 provided in the front head 40, so that the rod 70 in turn strikes and breaks an object.

However, such a breaker has a problem in that, when distortion stress occurs in the striking rod upon striking rocks or the like, the distortion stress is concentrated on connecting portions between the front head and the cylinder and between the cylinder and the head cap, so that the stress is applied to the long bolts threaded through the connecting portions, causing deformation such as bending or breakage, thereby deteriorating the reliability of the connection.

Further, another problem is that the construction of the plurality of variable dampers 30-1, 30-2, 40-1, and 50-1, which are provided on the inside of the casing 60 so as to support the front head 40, the cylinder 50, and the head cap 30, respectively, suffers from abrasion resulting from friction caused by vibrations or the like, which increases the shear load applied to the long bolts 80, thereby degrading the durability thereof.

In order to solve this problem of abrasion in the variable dampers, Korean Registered Utility Model No. 381252 has been disclosed, which, as shown in FIG. 2, includes a bracket assembly having front and rear brackets 3*a* and 3*b* and a plurality of side brackets 3*c*, which are assembled into a box shape to form an assembling space into which an assembly body is inserted, and a bulk member 4 and a lower member 5 respectively assembled on upper and lower portions of the bracket assembly with upper and lower dampers 7*a* and 7*b* composed of urethane interposed therebetween, wherein the assembly body has a piston which moves up and down when pressure is applied thereto, and a chisel 6 receiving an impact force from the piston.

In the assembly body, a plurality of side dampers 8*a*, 8*b*, and 9*a* is disposed, the side dampers 8*a* and 8*b* consisting of respective urethane members 81*a* and 81*b* and pairs of front and rear plates 83*a* and 82*a* and 83*b* and 82*b*, which are disposed on opposite sides of the urethane members so as to be assembled with assembling protrusions 31 provided in the front and rear brackets 3*a* and 3*b*, and being composed of wear-resistant synthetic resinous material.

However, such a hydraulic breaker has problems as follows. Since the urethane members become damaged due to frequent vibrations and impacts, gaps are created between the assembly body and the side dampers, generating noise and vibrations. Since the piston cannot accurately strike the chisel as the gaps expand gradually, the damage to the assembly body is accelerated, and the durability and reliability of a product are reduced. Since all the side dampers have to be replaced when eccentric abrasion occurs, unnecessary waste is caused.

DISCLOSURE

[Technical Problem]

Accordingly, the present invention has been made in an effort to solve the problems occurring in the related art, and an object of the present invention is to provide a hydraulic breaker assembly which allows a head cap, a cylinder, and a front head to be firmly combined, which also allows transference of an impact to the whole of the breaker assembly while preventing distortion stress generated on a striking rod from being concentrically transferred to a long bolt, which protects the long bolt from the distortion stress repetitively generated upon the striking of the rod, which reduces impact vibrations and impact noise of the breakers to safely protect respective dampers from friction abrasion and friction heat, and which constantly supports the front head, the cylinder, and the head cap in position to lower the error rate of the breaker assembly while increasing the lifetimes of the respective dampers and the breaker assembly.

[Technical Solution]

In order to achieve the above object, according to an aspect of the present invention, there is provided a hydraulic breaker assembly including a head cap, a cylinder, and a front head in a casing, wherein corresponding faces of the front head and the cylinder, which are built in the casing, are connected by a plurality of connecting pins, the cylinder and the head cap located above the cylinder are fixed together by a plurality of fastening bolts, and the front head, the cylinder, and the head cap are supported on an inner side of the casing by one or more variable dampers, which are brought in close contact with the outsides of the front head, the cylinder, and the head cap.

In an embodiment, the cylinder may have a fixing step, in which a side stopper, one side of which is fixed to the head cap, is fitted, and when a side cover fixed to the front head is coupled to the casing, the cylinder and the front head are securely combined together.

In an embodiment, the casing may be provided on one inner face with a reference damper and on the other corresponding inner face with a variable damper.

In an embodiment, the front head may have a maximum striking area in cross section between a piston and a rod, which are installed in the front head.

[Advantageous Effects]

In the hydraulic breaker assembly according to the present invention, the head cap, the cylinder, and the front head are prevented from moving in the casing and are firmly combined, the length of the long bolt is shortened to minimize an impact-generating section and protect the long bolt from the distortion stress generated upon the striking of the rod, hence improving the durability, and impact vibrations and impact noise of the breaker are reduced to safely protect respective dampers from friction abrasion and friction heat.

Further, the front head, the cylinder, and the head cap are constantly supported in position in order to lower the error rate of the breaker assembly and to increase the lifetimes of the respective dampers and the breaker assembly.

Furthermore, the error rate of the hydraulic breaker assembly is reduced due to its strong assembly which thereby considerably elongates the useful lifetime of a product.

MODE FOR INVENTION

Reference will now be made in greater detail to an exemplary embodiment of the invention, which is illustrated in the accompanying drawings.

Figure 1:
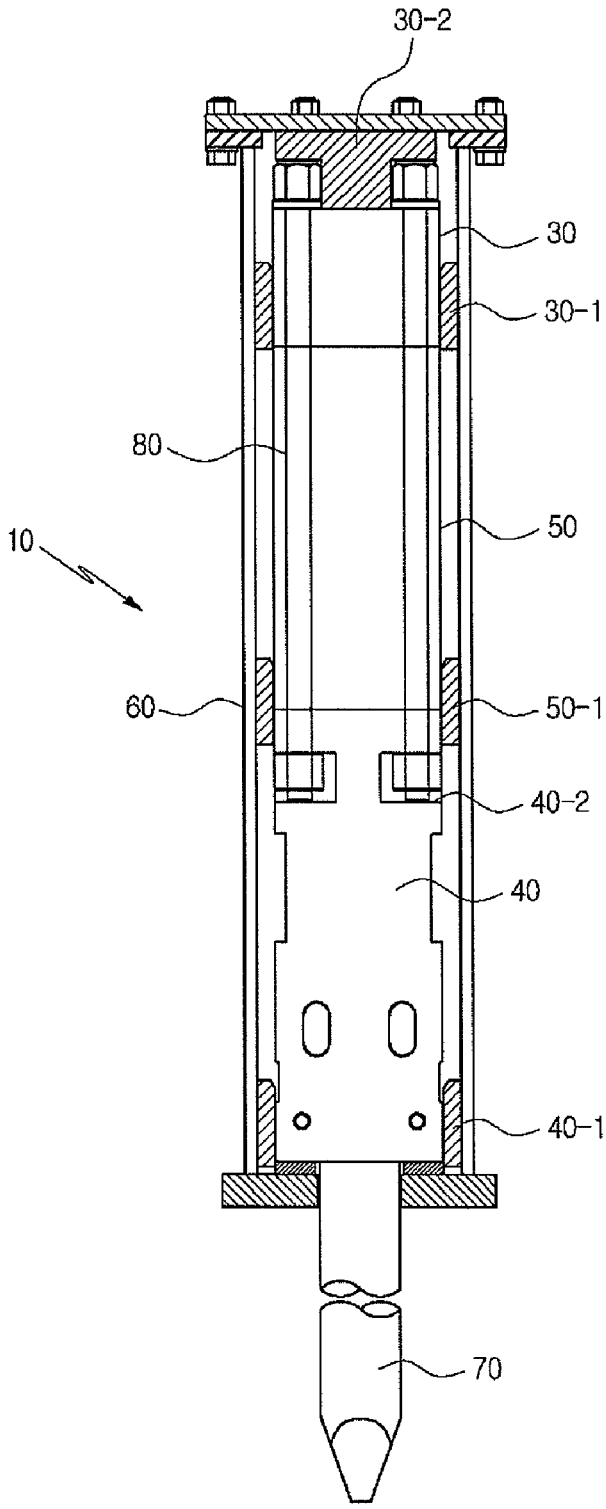
Fig. 1 Prior Art
FIG. 1 is a cross sectional view illustrating a breaker assembly according to the prior art.
Figure 2:
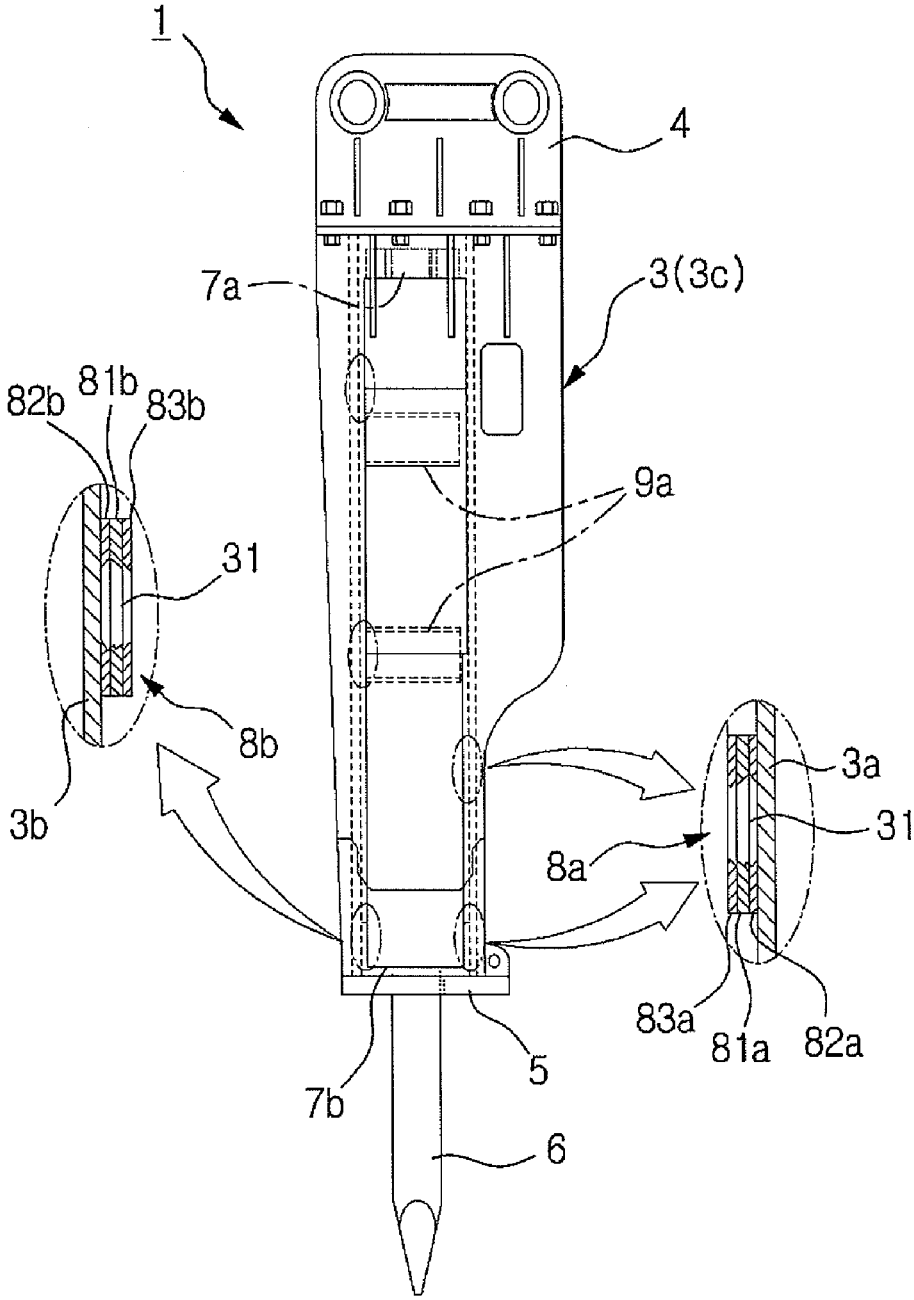
Fig. 2 Prior Art
FIG. 2 is a cross sectional view illustrating the state in which a damper for the prior art breaker assembly is mounted.
Figure 3:
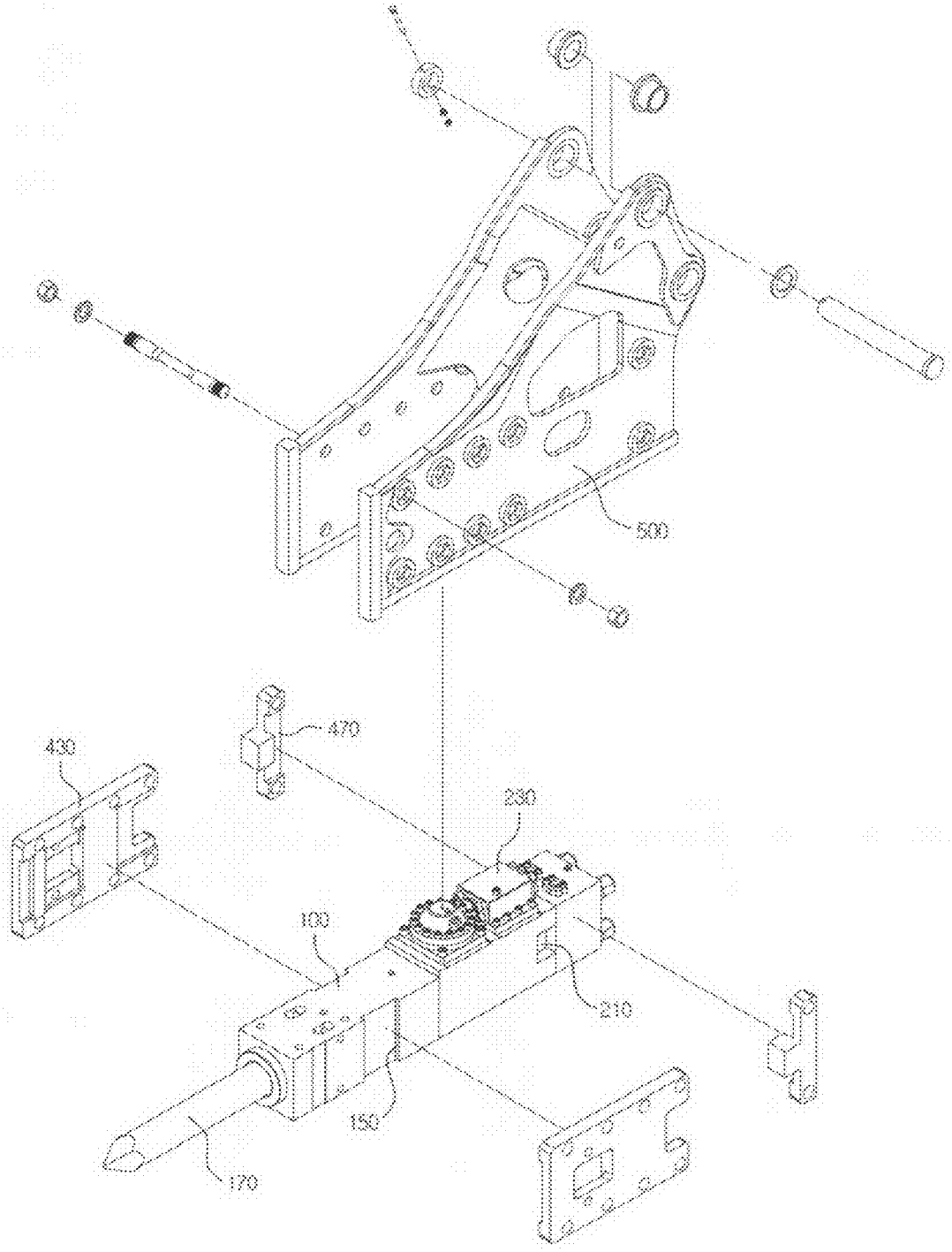
FIGS. 3 and 4 are views illustrating the states in which a hydraulic breaker assembly according to the present invention is disassembled and assembled.
Figure 4:
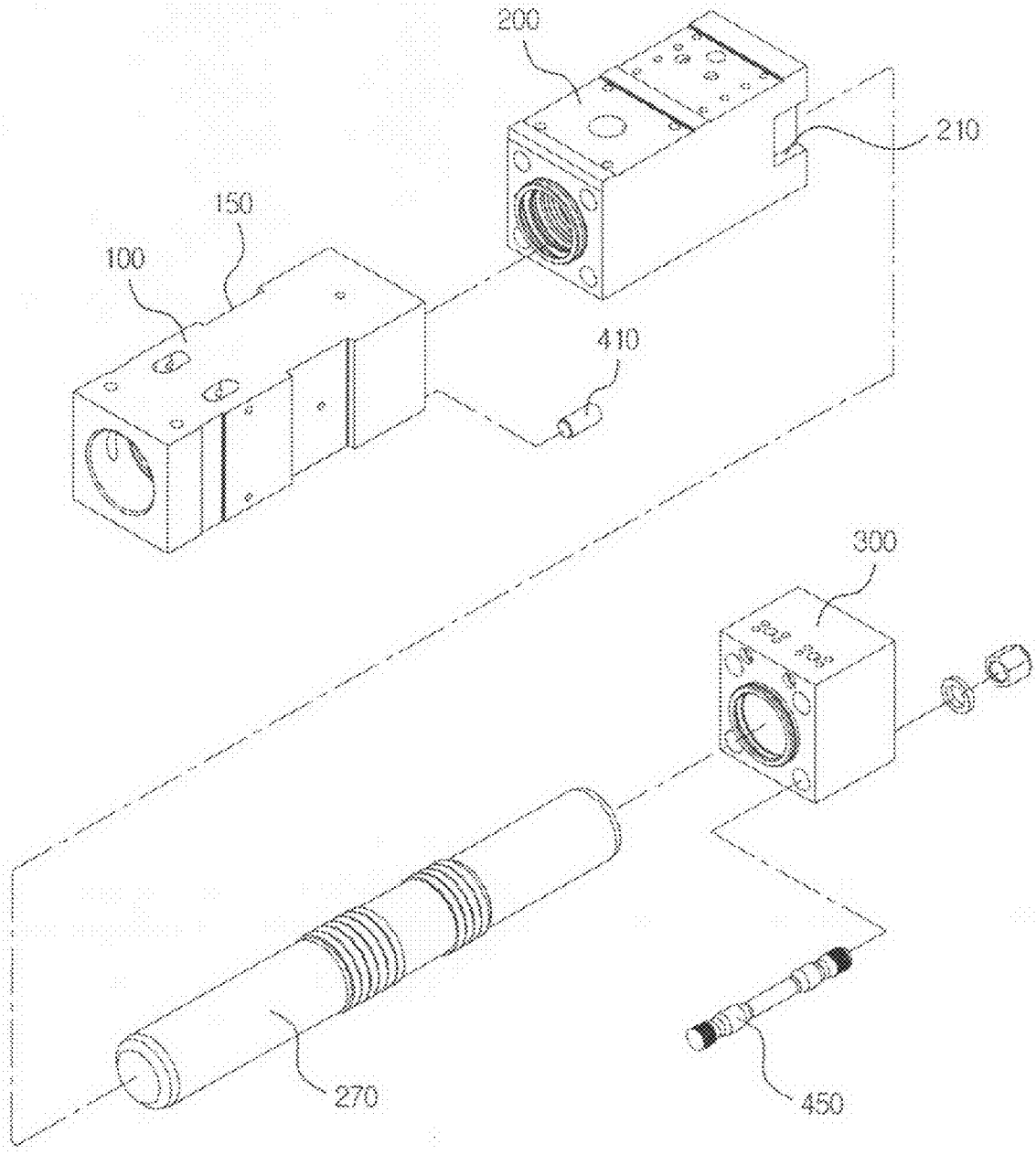
Figure 5:
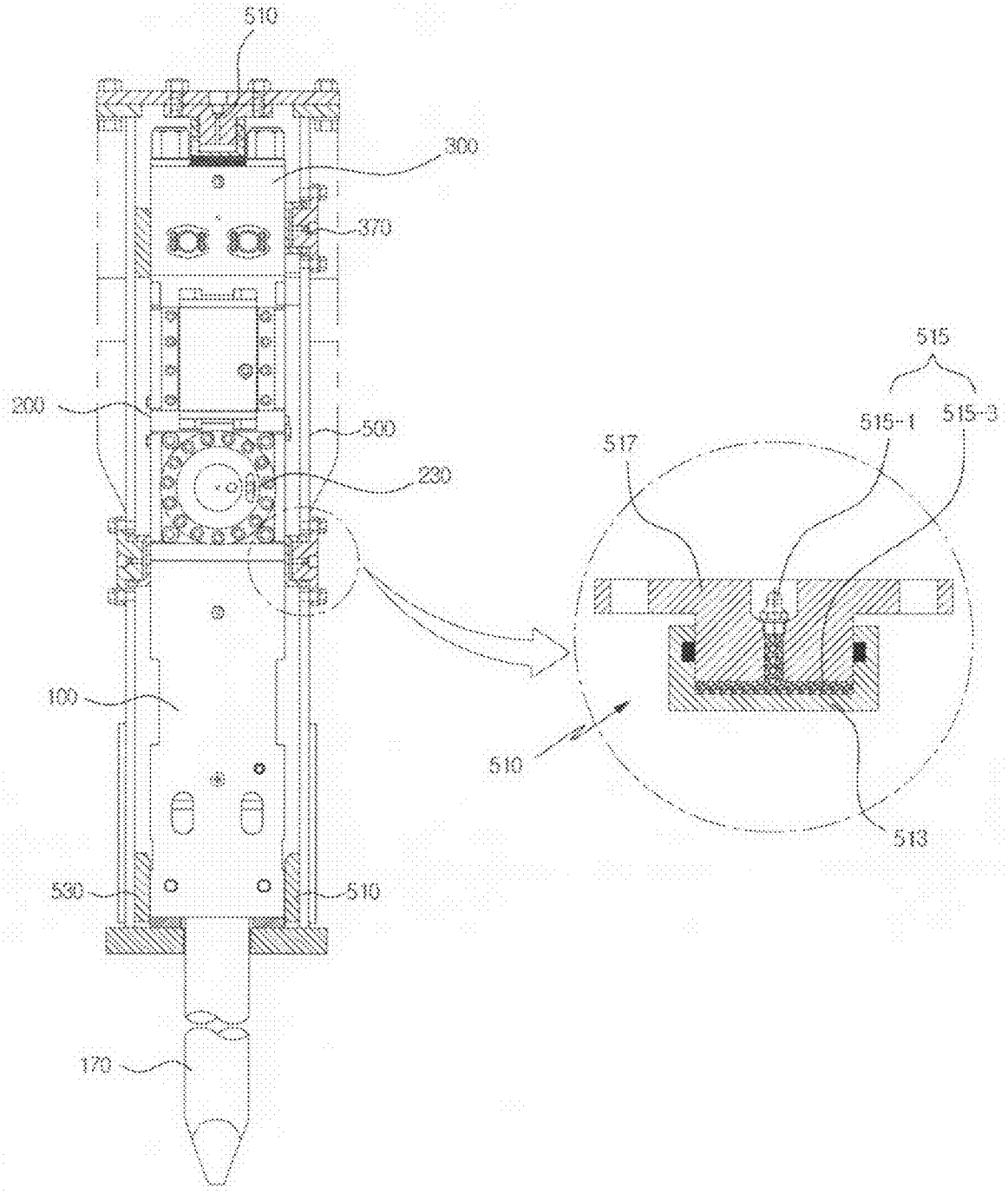
FIG. 5 is a partial exploded cross sectional view illustrating the hydraulic breaker assembly according to the present invention.
Figure 6:
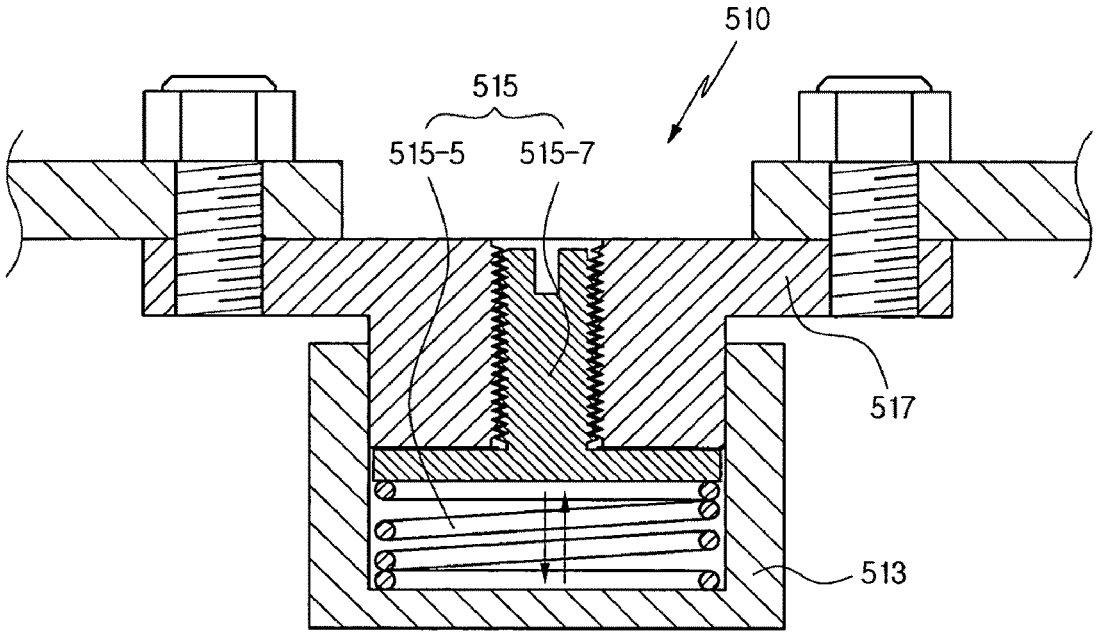
FIG. 6 is a partial cross sectional view illustrating the state in which a damper is mounted in a hydraulic breaker assembly according to another embodiment of the present invention.
Figure 7:
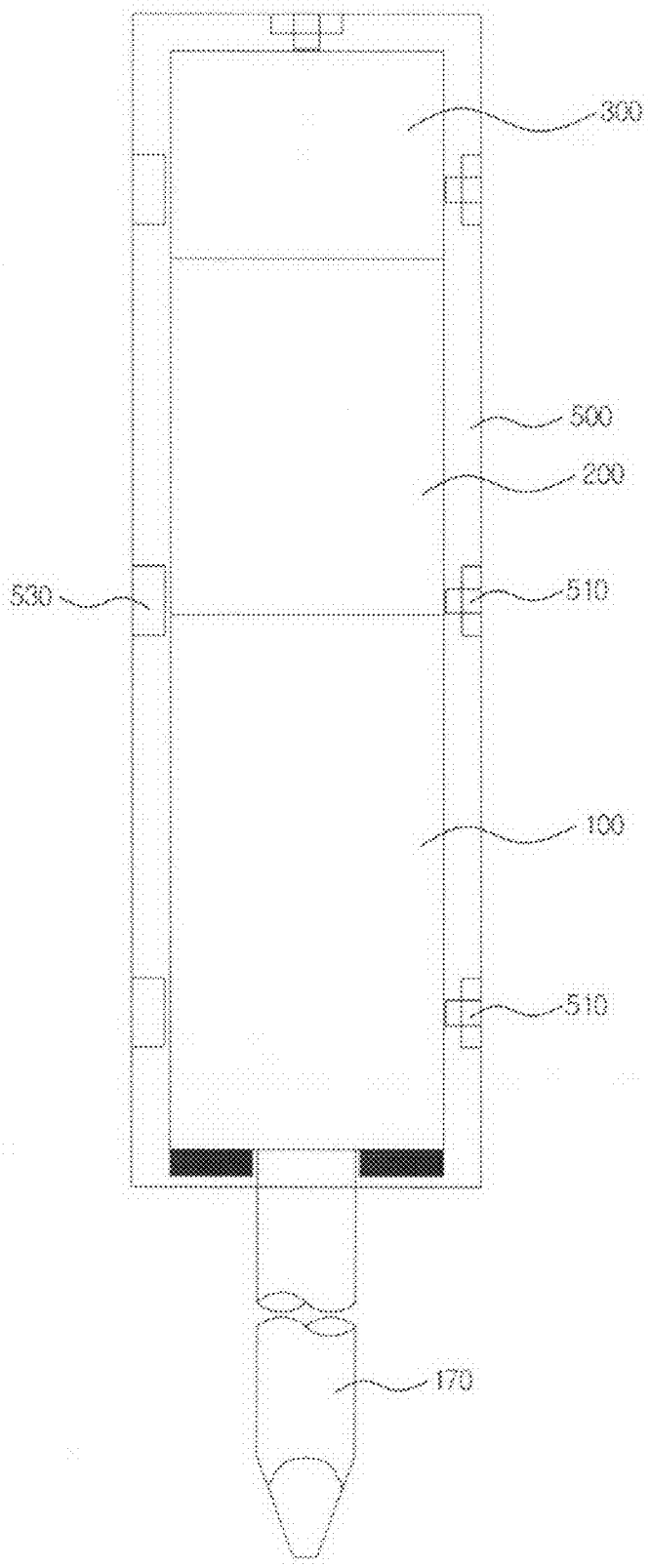
FIGS. 7 and 8 are schematic views illustrating dampers according to the present invention.
Figure 8:
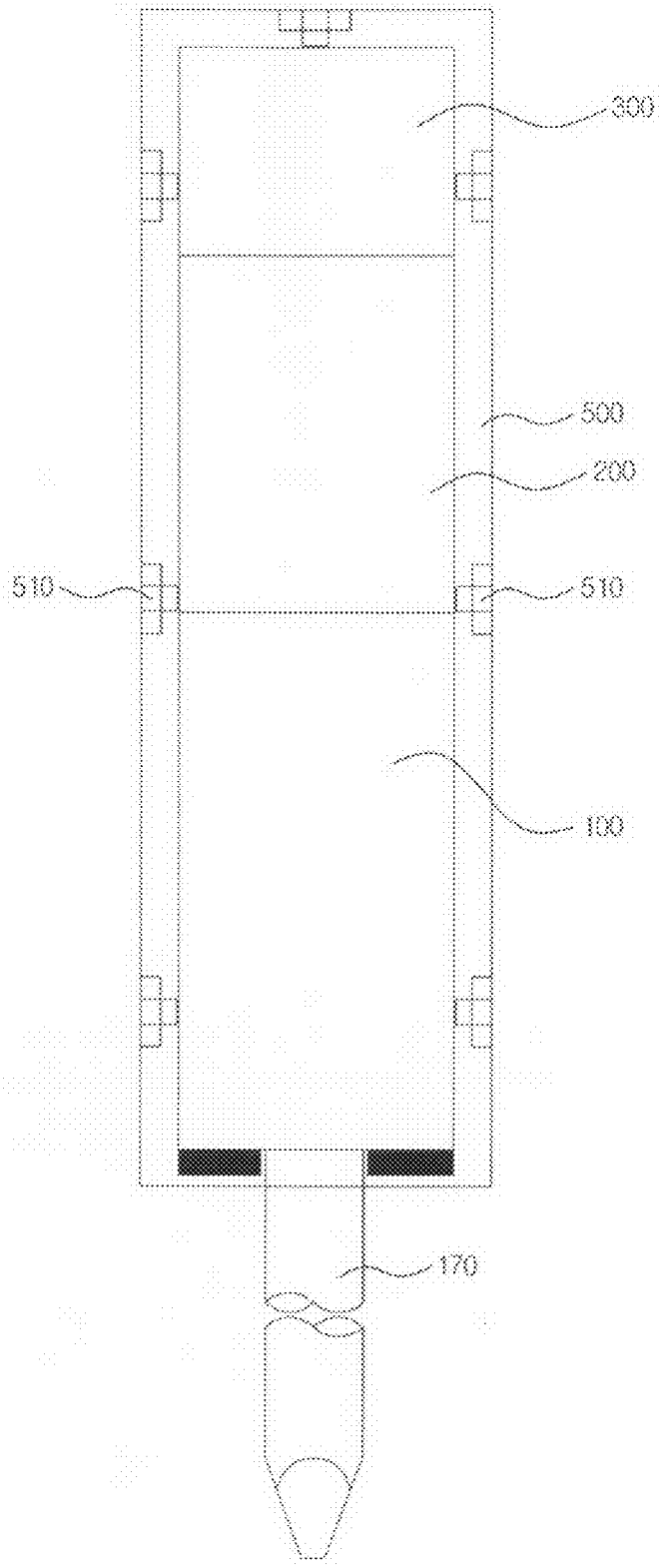
Figure 9:
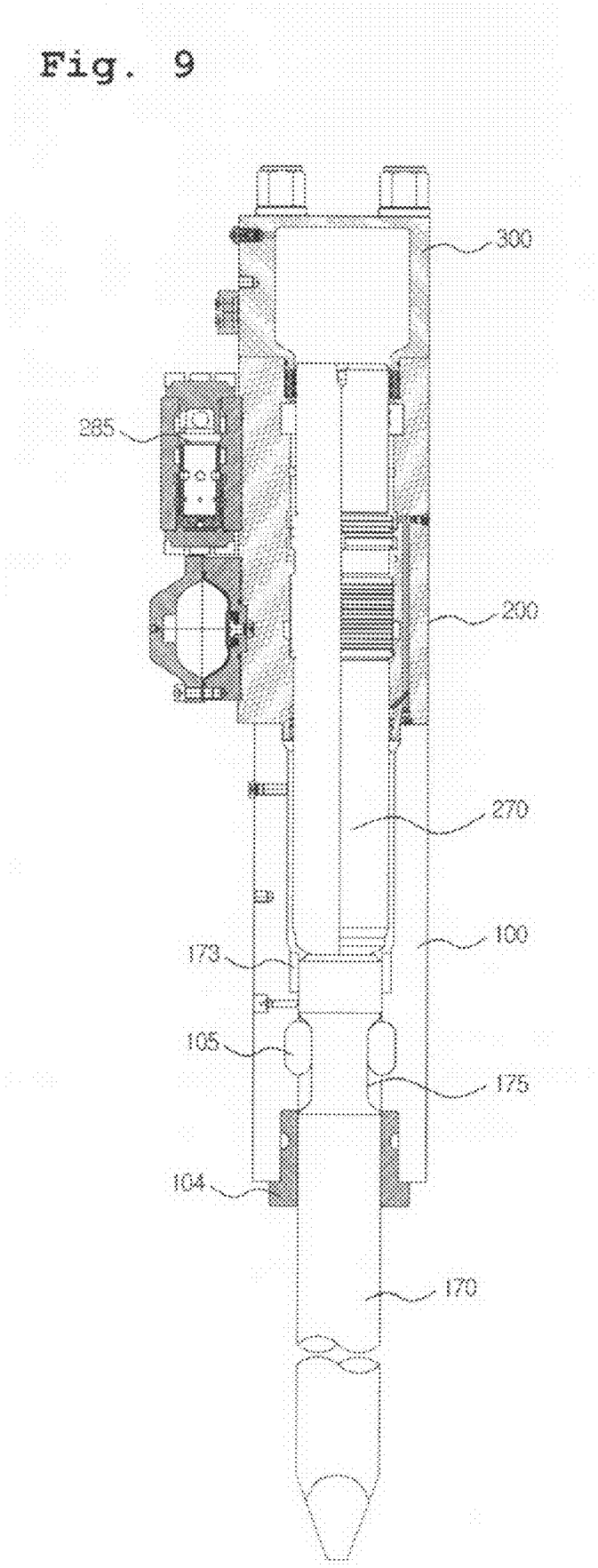
FIGS. 9 and 10 are a cross sectional view and a partially enlarged view respectively illustrating the states in which a rod is mounted in a hydraulic breaker assembly according to another embodiment of the present invention.
Figure 10:
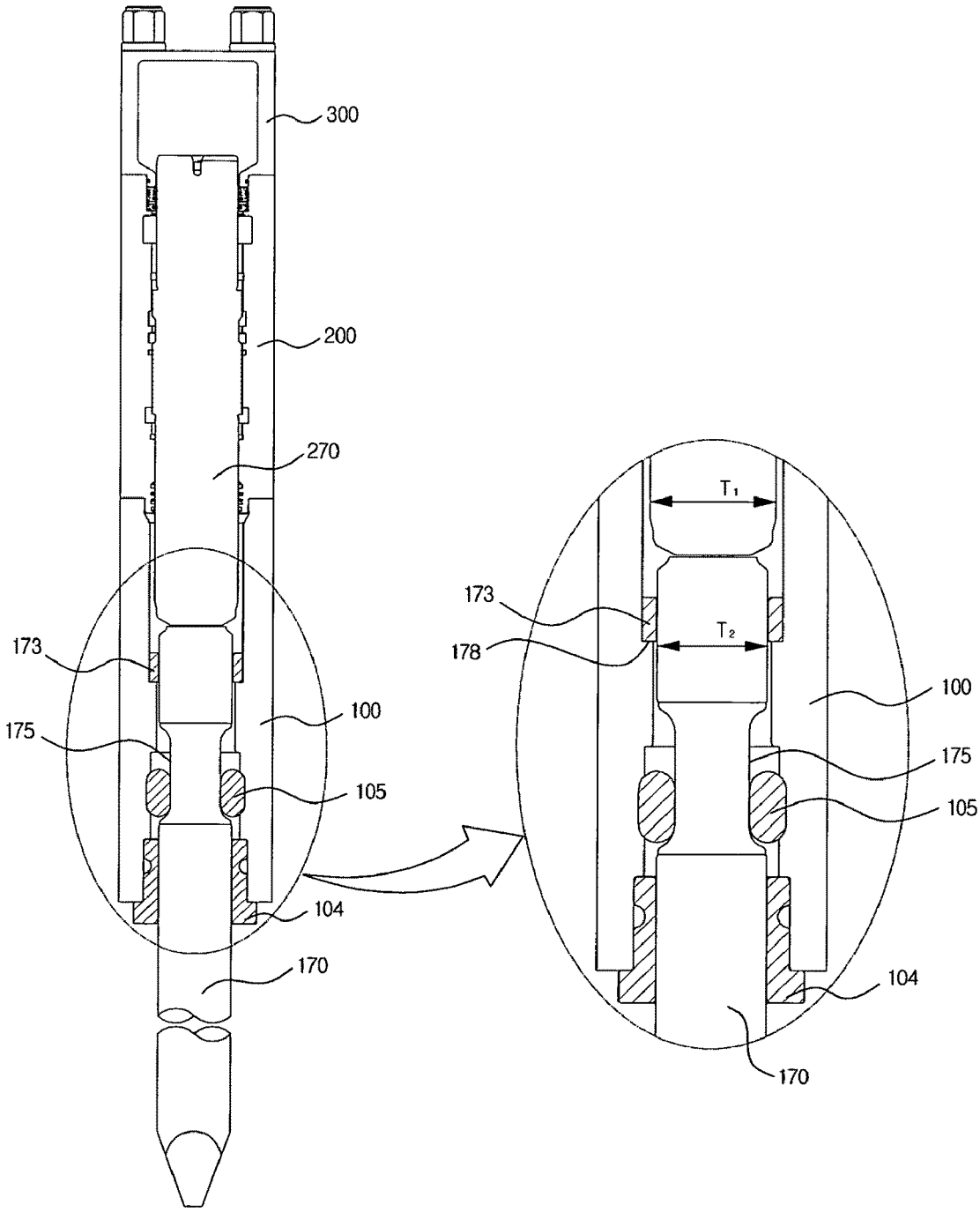

FIGS. 3 and 4 are views illustrating the states in which a hydraulic breaker assembly according to the present invention is disassembled and assembled. FIG. 5 is a partial exploded cross sectional view illustrating the hydraulic breaker assembly according to the present invention. FIG. 6 is a partial cross sectional view illustrating the state in which a damper is mounted in a hydraulic breaker assembly according to another embodiment of the present invention. FIGS. 7 and 8 are schematic views illustrating the adaptations of dampers according to the present invention. FIGS. 9 and 10 are a cross sectional view and a partially enlarged view respectively illustrating the states in which a rod is mounted in a hydraulic breaker assembly according to another embodiment of the present invention.

In the hydraulic breaker assembly of the present invention, a front head 100 and a cylinder 200, which contain at least a portion of a rod 170 and a portion of a piston 270 which strikes the rod, are connected together by a plurality of connecting pins 410.

The cylinder 200 and a head cap 300 located on the cylinder are fixed by a fastening bolt 450 having threads on opposite ends thereof.

The cylinder 200 has fixing steps 210 on opposite sides of one end thereof, into which one first sides of side stoppers 470 are respectively closely fitted, the other second sides of the side stoppers being coupled to the head cap 300.

Further, the side stopper 470 has a protrusion which is formed on one side thereof corresponding to the fixing step of the cylinder 200, and is closely fitted thereto.

Then, the head cap 300, the cylinder, and the front head 100 are connected together in the inside of a casing 500.

Herein, a plurality of variable dampers 510 is provided in the casing 500 so as to position the head cap 300, the cylinder 200, and the front head 100.

Further, the front head 100 has mounting recesses 150 on opposite sides thereof, into which corresponding side covers 430 are fitted.

Meanwhile, in the casing 500, the variable damper 510 is movably installed so as to prevent the head cap 300, the cylinder 200, and the front head 100 from moving upon installation in the casing 500, and a fixed damper 530 is further provided opposite the variable damper 510.

Here, instead of installing the fixed damper 530, only the variable damper 510 may be installed.

Further, the fixed damper 530 is composed of steel or urethane, which is resistant to friction.

Then, in the variable damper 510, a distance-regulating spacer 513 for minimizing breakage and abrasion is provided in front of a fixed block 517 such that its position may be varied by means of a distance-regulator 515.

The distance-regulator 515 includes a check valve 515-1 guiding a flowing direction of supplied hydraulic or pneumatic pressure, and fluid 515-3 filled between the fixed block and the distance-regulating spacer for the use of hydraulic or pneumatic pressure.

The distance-regulator 515 includes a coil spring 515-5 inserted between the fixed block and the distance-regulating spacer, and an adjusting bolt 515-7 engaged with the fixed block to adjust the compression force of the spring.

The impact portion between the rod 170 connected to the front head 100 and the piston 270 received in the cylinder 200 has maximum cross sectional areas T1 and T2 defined by the piston and the rod, respectively.

The downward movement of the piston 270 is controlled by a bushing 173 which is supported by an engaging step 178 provided in the front head 100.

The upward and downward movement of the rod 170 is controlled by rod pins 105 which are positioned in the front head 100 so as to face each other on opposite guide recesses 175 formed on the rod 170.

Here, a cover 104 is fixed to a lower portion of the front head 100 so as to support the rod 170 on the front head 100.

The operation of the present invention as constructed above will now be described.

As illustrated in FIGS. 3 to 10, according to the hydraulic breaker assembly of the invention, upon assembling the head cap 300, the cylinder 200, and the front head 100, only the cylinder 200 and the head cap 300, to which the greatest impact force is applied upon the operation of the breaker assembly, are fastened by a plurality of fastening bolts 450 each having threads in opposite ends thereof.

Then, in order to improve the fastening force between the cylinder 200 and the head cap 300, the side stopper 470 is further coupled thereto such that one side thereof is fastened to the head cap 300, and the other side thereof is fitted to the fixing step 210 of the cylinder 200, thereby preventing the fastened head cap and cylinder from moving.

The cylinder 200 and the front head 100 are prevented from moving downwards when the side cover 430, which is positioned by the mounting recess 150 of the front head 100, is coupled to the casing 500.

The side stopper 470 strongly supports the cylinder 200 and the head cap 300 when positioned and coupled to one side of the casing 500 using a bolt.

Here, the plurality of variable dampers 510 located in the casing 500 prevents damage to the cylinder and the like and also absorbs vibrations when the cylinder, the head cap, and the front head create friction against the casing.

The casing 500 may have an assembled structure, but may also have an integrated structure so that the front head 100, the cylinder 200, and the head cap 300 can be received therein.

The side cover 430 and the side stopper 470, which are coupled to the casing 500, strongly hold the front head 100 and the cylinder 200 together using the fastening bolts and the connecting pins, thereby preventing leakage of fluid which acts upon the cylinder.

Meanwhile, the variable damper 510 or the fixed damper 530 is selectively provided in the casing 500 so as to be close to the front head 100, the cylinder 200, and the head cap 300, which are coupled together like the above structure, thereby positioning them in the casing.

In installing the damper, the fixed damper 530, made of steel or impact-resistant and wear-resistant nylon or urethane, is first mounted as a reference damper, and then the variable damper 510 which is adjustable in its extension is mounted at a position opposite the reference damper, so that even upon the occurrence of damage of the fixed damper 530, the variable damper 510 regulates the adhering force to thereby prevent vibrations and noise.

Further, when the rod 170 reciprocates to strike an object so as to transfer impact vibrations, the fixed damper or the variable damper, which is provided above the head cap or below the front head, absorbs the impact vibrations.

Here, the fixed damper 530 and the variable damper 510 are selected in a preferred combination that is suitable for supporting the front head 100, the cylinder 200, and the head cap 300 in the casing 500.

The variable damper 510 includes the distance-regulating spacer 513 made of nylon minimizing the breakage and abrasion, and the distance-regulator 515 elastically moving the distance-regulating spacer from the fixed block 517.

The distance-regulator 515 includes the check valve 515-1, which guides a flowing direction of hydraulic or pneumatic pressure while supplying hydraulic or pneumatic pressure, and fluid 515-3 so as to move the distance-regulating spacer according to the supply of hydraulic or pneumatic pressure.

Further, the distance-regulator 515 includes the coil spring 515-5 and the adjusting bolt 515-7 which adjusts the compression force of the spring, so that, when an operator adjusts the adjusting bolt, the compression force of the spring increases to move down the distance-regulating spacer, covering a gap between the reference damper and the breaker.

Meanwhile, the rod 170 mounted in the front head 100 is configured such that upward/downward movement thereof is controlled by only the single rod pin 105, such that the cross sectional area T2 of the upper end thereof is maximized, and further, such that the upward/downward movement thereof is supported by the bushing 173, so that the shaking of the rod is prevented, and the impact force is distributed evenly over the rod 170.

Further, the piston 270 brought into contact with the rod 170 is made such that a cross sectional area T1 is maximized on its lower end, so that upon collision against the rod 170, the impact force is distributed all over the piston 270.

In joining the piston with the rod, both of which are mounted in the cylinder 200 and the front head 100, after the rod 170 supported by the rod pin 105 and the bushing 173 is inserted, the piston in turn is inserted onto the rod, and the cover 104 is coupled to the front head 100 so as to prevent the rod from being removed.

The bushing 173 is supported by the engaging step 178 of the front head 100 so as to be prevented from moving downward.

Here, the bushing 173 is externally supplied with lubricant oil from an oil supply unit (not shown) provided in the front head 100 so as to facilitate the movement of the rod 170.

The rod 170 having the guide recess 175 has the uppermost position to which it moves determined by only the rod pin 105, which makes it possible to remove a step for controlling the uppermost position to which the rod moves according to the prior art, thereby preventing the stress concentration of the step.

As set forth before, according to the present invention, only the head cap 300 and the cylinder 200, to which is applied a maximum stress upon striking of the rod 170, are fastened by the fastening bolt 450, and the front head 100 and the cylinder 200 are supported by only the connecting pin 410 while the outer sides thereof are supported again by the side cover 430 and the side stopper 470, thereby eliminating a defect-causing phenomenon resulting from stress occurring upon supporting the whole structure by a single long bolt.

Further, the outsides of the front head 100, the cylinder 200, and the head cap 300 are supported by one or more fixed dampers 530 or variable dampers 510, thereby preventing them from moving in the casing 500.

[Industrial Applicability]

According to the hydraulic breaker assembly of the present invention, the durability is improved, the impact force upon striking is absorbed to minimize noise, and the head cap, the cylinder, and the front head, which are located in the casing, are safely protected from friction abrasion and friction heat.

The invention claimed is:

1. A hydraulic breaker assembly comprising:

a head cap, a cylinder, and a front head, which are mounted in a casing, wherein corresponding faces of the front head and the cylinder, which are built in the casing, are connected by a plurality of connecting pins, wherein the cylinder and the head cap located above the cylinder are fixed together by a plurality of fastening bolts, wherein the front head, the cylinder, and the head cap are supported on an inner side of the casing by one or more variable dampers, which are brought into close contact with the outsides of the front head, the cylinder, and the head cap, and the variable damper comprises a fixed block fixed to the casing, and a distance-regulating spacer variable in its position in front of the fixed block using a distance-regulator.

2. The hydraulic breaker assembly as set forth in claim 1, wherein the cylinder is further provided with a fixing step, in which a side stopper, one side of which is fixed to the head cap, is fitted at the other side to position the cylinder and the head cap.

3. The hydraulic breaker assembly as set forth in claim 1, wherein the front head is further provided with a mounting recess, in which a side cover coupled to the casing is fitted to position the front head.

4. The hydraulic breaker assembly as set forth in claim 1, wherein the distance-regulator comprises fluid forming hydraulic or pneumatic pressure, and a check valve guiding a flowing direction of the fluid while preventing a pressure loss of the fluid.

5. The hydraulic breaker assembly as set forth in claim 1, wherein the distance-regulator comprises a coil spring and an adjusting bolt fastened to the fixed block so as to adjust the compression force of the spring.

6. The hydraulic breaker assembly as set forth in claim 1, wherein the front head is provided such that a piston and a rod, which are mounted therein, have a maximum striking cross sectional area therebetween.

7. The hydraulic breaker assembly as set forth in claim 6, wherein the rod is configured such that its upward/downward movement resulting from striking by the piston is controlled by a rod pin.

8. The hydraulic breaker assembly as set forth in claim 6, wherein the rod is supported by a bushing which is fixed by an engaging step provided in the front head, and the rod is provided with guide recesses on opposite sides thereof such that upon moving down by the piston and moving up by repulsive force, rod pins are brought into contact with the guide recesses.

9. A hydraulic breaker assembly comprising:

a head cap, a cylinder, and a front head, which are mounted in a casing, wherein corresponding faces of the front head and the cylinder, which are built in the casing, are connected by a plurality of connecting pins, wherein the cylinder and the head cap located above the cylinder are fixed together by a plurality of fastening bolts, wherein the front head, the cylinder, and the head cap are supported on an inner side of the casing by one or more fixed dampers and variable dampers, provided opposite to the fixed dampers, which are brought in close contact with the outsides of the front head, the cylinder, and the head cap, and the variable damper comprises a fixed block fixed to the casing, and a distance-regulating spacer variable in its position in front of the fixed block by a distance-regulator.

10. The hydraulic breaker assembly as set forth in claim 9, wherein the cylinder is further provided with a fixing step, in which a side stopper, one side of which is fixed to the head cap, is fitted at the other side to position the cylinder and the head cap.

11. The hydraulic breaker assembly as set forth in claim 9, wherein the front head is further provided with a mounting recess, in which a side cover coupled to the casing is fitted to position the front head.

12. The hydraulic breaker assembly as set forth in claim 9, wherein the distance-regulator comprises fluid forming hydraulic or pneumatic pressure, and a check valve guiding a flowing direction of the fluid while preventing a pressure loss of the fluid.

13. The hydraulic breaker assembly as set forth in claim 9, wherein the distance-regulator comprises a coil spring and an adjusting bolt fastened to the fixed block so as to adjust the compression force of the spring.

14. The hydraulic breaker assembly as set forth in claim 9, wherein the front head is provided such that a piston and a rod, which are mounted therein, have a maximum striking cross sectional area therebetween.

15. The hydraulic breaker assembly as set forth in claim 14, wherein the rod is configured such that its upward/downward movement resulting from being struck by the piston is controlled by a rod pin.

16. The hydraulic breaker assembly as set forth in claim 14, wherein the rod is supported by a bushing which is fixed by an engaging step provided in the front head, and the rod is provided with guide recesses on opposite sides thereof such that upon moving down by the piston and moving up by repulsive force, rod pins are brought into contact with the guide recesses.

17. The hydraulic breaker assembly as set forth in claim 9, wherein the fixed damper is made of steel, minimizing friction.

18. A hydraulic breaker assembly comprising:

a head cap, a cylinder, and a front head, which are mounted in a casing, wherein corresponding faces of the front head and the cylinder, which are built in the casing, are connected by a plurality of connecting pins, wherein the cylinder and the head cap located above the cylinder are fixed together by a plurality of fastening bolts, wherein the front head, the cylinder, and the head cap are supported on an inner side of the casing by one or more fixed dampers and one or more variable dampers provided opposite to the fixed dampers, which are brought into close contact with the outsides of the front head, the cylinder, and the head cap, wherein the front head is provided such that a piston and a rod, which are mounted therein, have a maximum striking cross sectional area therebetween, the variable damper comprises a fixed block fixed to the casing, and a distance-regulating spacer variable in its position in front of the fixed block by a distance-regulator, and the fixed damper is made of steel, minimizing friction.

19. The hydraulic breaker assembly as set forth in claim 18, wherein the cylinder is further provided with a fixing step, in which a side stopper, one side of which is fixed to the head cap, is fitted at the other side to position the cylinder and the head cap.

20. The hydraulic breaker assembly as set forth in claim 18, wherein the front head is further provided with a mounting recess, into which a side cover coupled to the casing is fitted to position the front head.

21. The hydraulic breaker assembly as set forth in claim 18, wherein the distance-regulator comprises fluid forming hydraulic or pneumatic pressure, and a check valve guiding a flowing direction of the fluid while preventing a pressure loss of the fluid.

22. The hydraulic breaker assembly as set forth in claim 18, wherein the distance-regulator comprises a coil spring and an adjusting bolt fastened to the fixed block so as to adjust the compression force of the spring.

23. The hydraulic breaker assembly as set forth in claim 18, wherein the rod is configured such that its upward/downward movement resulting from being struck by the piston is controlled by a rod pin.

24. The hydraulic breaker assembly as set forth in claim 18, wherein the rod is supported by a bushing which is fixed by an engaging step provided in the front head, and the rod is provided with guide recesses on opposite sides thereof such that upon moving down by the piston and moving up by repulsive force, rod pins are brought into contact with the guide recesses.

* * * * *